US006322189B1

(12) United States Patent
Anderson et al.

(10) Patent No.: US 6,322,189 B1
(45) Date of Patent: Nov. 27, 2001

(54) MULTIPLE PRINTHEAD APPARATUS WITH TEMPERATURE CONTROL AND METHOD

(75) Inventors: Daryl E. Anderson; Dennis Schloeman; Jeffery S. Beck, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/231,331

(22) Filed: Jan. 13, 1999

(51) Int. Cl.[7] ..... B41J 29/38
(52) U.S. Cl. ..... 347/17
(58) Field of Search ..... 347/17, 14, 18, 347/88, 60, 67, 42

(56) References Cited

U.S. PATENT DOCUMENTS

| | | | | |
|---|---|---|---|---|
| 4,791,435 | | 12/1988 | Smith et al. | 346/140 R |
| 4,899,180 | | 2/1990 | Elhatem et al. | 346/140 R |
| 4,910,528 | | 3/1990 | Firl et al. | 346/1.1 |
| 5,075,690 | | 12/1991 | Kneezel | 346/1.1 |
| 5,107,276 | | 4/1992 | Kneezel et al. | 346/1.1 |
| 5,132,709 | * | 7/1992 | West | 347/191 |
| 5,220,345 | * | 6/1993 | Hirosawa | 347/17 |
| 5,265,315 | * | 11/1993 | Hoisington et al. | 347/17 |
| 5,422,662 | | 6/1995 | Fukushima et al. | 342/211 |
| 5,428,376 | | 6/1995 | Wade et al. | 347/14 |
| 5,477,245 | | 12/1995 | Fuse | 347/10 |
| 5,760,797 | * | 6/1998 | Koizumi et al. | 347/17 |
| 5,815,180 | | 9/1998 | Barbour et al. | 347/59 |
| 5,838,341 | * | 11/1998 | Hiwada | 347/17 |
| 5,851,075 | * | 12/1998 | Imai | 347/17 |
| 5,966,149 | * | 10/1999 | Kamada et al. | 347/42 |
| 6,068,363 | * | 3/2000 | Saito | 347/17 |

FOREIGN PATENT DOCUMENTS

| | | | |
|---|---|---|---|
| 0511602A1 | 11/1992 | (EP) | B41J/2/05 |
| 0824243A2 | 2/1998 | (EP) | G06K/15/10 |
| 10-230594 | 9/1998 | (JP) | B41J/2/01 |
| 3218840 | 9/1991 | (JP) | B41J/2/05 |
| 8-216407 | 8/1996 | (JP) | B41J/2/05 |

* cited by examiner

*Primary Examiner*—John Barlow
*Assistant Examiner*—Julian D. Huffman

(57) ABSTRACT

An apparatus and method for controlling temperature fluctuations between printhead dies in a multiple printhead die printer. By reducing temperature variations, changes in image intensity that are attributable to temperature variations are reduced.

5 Claims, 2 Drawing Sheets

MULTIPLE PRINTHEAD APPARATUS WITH TEMPERATURE CONTROL AND METHOD

FIELD OF THE INVENTION

The present invention relates to printheads with multiple printhead dies and, more specifically, to temperature control among the multiple printhead dies to improve print quality.

BACKGROUND OF THE INVENTION

Several types of printing devices are known in the art and they include laser, dot matrix, mechanical actuated ink jet and thermal actuated ink jet printers and the like. The present invention is particularly applicable to inkjet printers and, more specifically, to thermal actuated ink jet printers. Nonetheless, it should be recognized that the effects of temperature on ink and print quality may be an issue in all types of printers (because of the coefficient of expansion of ink and other materials, among other reasons) and thus, the present invention is applicable to all printers.

Ink jet printheads are known that include a semiconductive substrate or "die" on which are formed a plurality of firing chambers. Ink and control signals are provided to the firing chambers for controlled expulsion of ink. In order to achieve faster printing rates, the present invention contemplates providing a plurality of these dies in a side by side arrangement or the like (thereby creating a larger ink expulsion area), and such an arrangement is termed an array or module (hereinafter referred to as an "array").

When multiple dies are placed side by side to form a printhead array, however, print quality issues can arise. A principal concern stems from the performance of two neighboring dies that are operating at different temperatures. The concern usually manifests itself as a sudden change in image intensity at the interface between the dies. The change in image intensity is caused by different sized ink drops being expelled by the neighboring die because ink drop volume varies with die temperature. Thus, a need exists to provide a printhead array in which the printhead dies or the like are maintained at a more uniform temperature and thus produce ink drops of more uniform volume.

SUMMARY OF THE INVENTION

Accordingly, it is an object of the present invention to provide a multiple printhead arrangement that creates ink drops having an approximately uniform volume.

It is another object of the present invention to provide a multiple printhead arrangement in which the operating temperature of each printhead is controlled.

It is also an object of the present invention to provide a multiple printhead arrangement in which each of the printheads operate at approximately the same temperature.

These and related objects of the present invention are achieved by use of a multiple printhead apparatus with temperature control and method as described herein.

The attainment of the foregoing and related advantages and features of the invention should be more readily apparent to those skilled in the art, after review of the following more detailed description of the invention taken together with the drawings.

DETAILED DESCRIPTION

Figure 1:
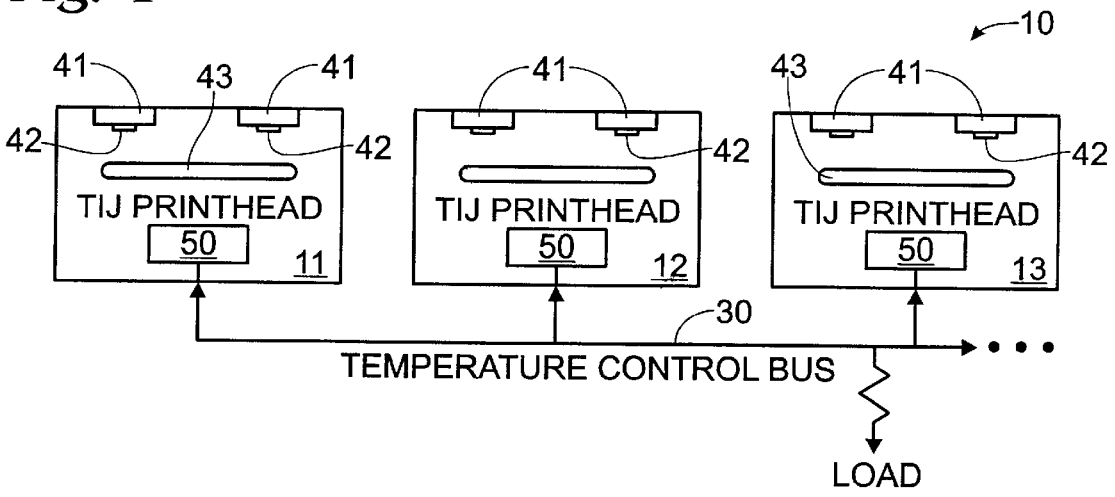
FIG. 1 is a side view of a plurality of printhead dies arranged in an array in accordance with the present invention.

Referring to FIG. 1, a side view of a plurality of printhead dies generally referred to herein as ("printheads") 11–13 arranged in an array 10 in accordance with the present invention is shown. While three printheads are shown in FIG. 1, it should be recognized that the present invention is applicable to any number of printheads greater than one. Each printhead includes at least one firing chamber 41 with an ink expulsion mechanism 42 such as a resistor (thermal actuation) or a piezo-electric actuator (mechanical actuation). A heating element such as a resistive heating element or the like 43 is also preferably provided in each printhead. If the heating element is implemented as a resistive heating element, it may be achieved as a resistor or transistor. Suitable heating elements are generally known in the art.

It should be recognized that the heating element represented by reference numeral 43 illustrates the provision of a heating source within a printhead that can heat the ink to a desired temperature. If the ink expulsion mechanism 42 is a thermal actuated mechanism, it is possible that the expulsion mechanism can serve the function of ink expulsion and ink warming. Thus, expulsion mechanism 42 would provide the functions represented by reference numeral 43. This can be achieved, for example, by sending a signal pulse that is of sufficient duration to heat ink in firing chamber 41 to a desired temperature, but not long enough to expel ink, or by sending a reduced current signal.

Each printhead is coupled to a shared temperature signal conductor 30. In an analog embodiment (discussed first), it is possible for the temperature signal conductor to be a single line that propagates a voltage representative of a temperature level. In a digital embodiment (discussed further below), the temperature signal conductor is preferably a bus driven by tri-state buffer drivers.

Temperature control logic or circuit 50 is preferably provided in each printhead and is coupled to the temperature signal conductor. Among other functions, each control circuit is capable of sensing the signal on conductor 30 and comparing this signal with the temperature of its printhead. Depending on the outcome of this comparison, the control logic either increases the temperature of the printhead, sends a signal to other printheads to increase their temperature or does neither. Analog and digital implementations are now presented.

In an analog embodiment, conductor 30 is preferably an analog signal line and each control circuit is configured to sense a voltage on conductor 30 that is indicative of temperature. If a given printhead is cooler than the bus temperature, than the heating element associated with that printhead is enabled. If the printhead is hotter than the bus temperature by a predefined temperature, $\Delta$, then a voltage signal representative of the hotter temperature (minus $\Delta$) is driven onto conductor 30 by circuit 50 of that printhead. If the printhead temperature detected at logic 50 is not greater than $\Delta$ degrees above the temperature on line 30, then no action is taken.

Figure 2:
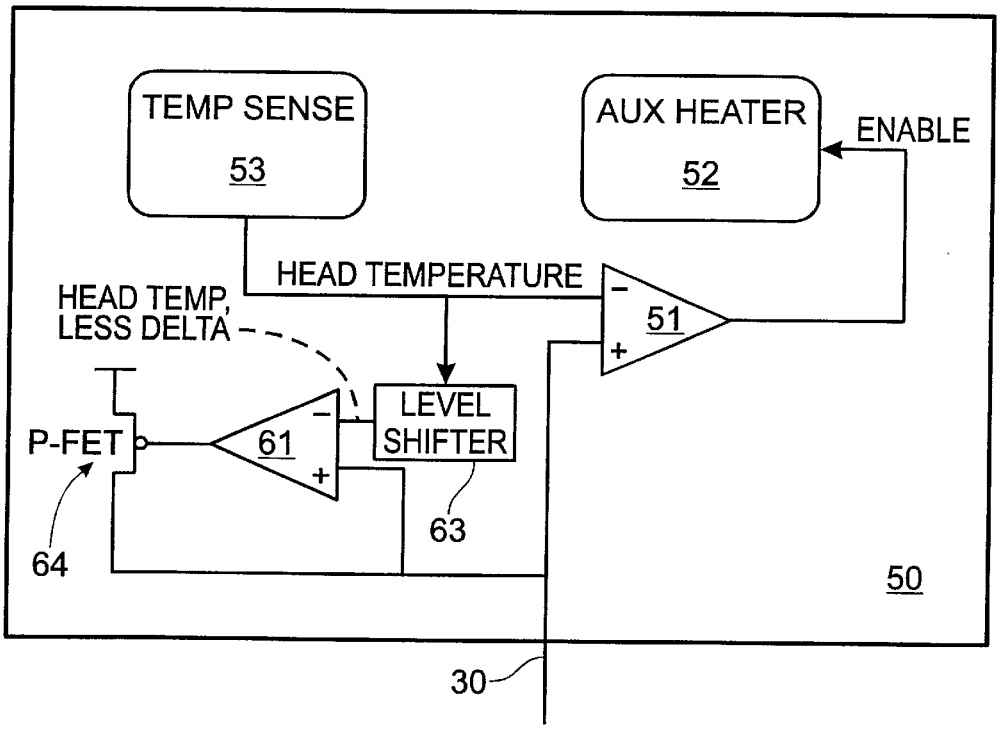
FIG. 2 is a schematic diagram of an analog implementation of a temperature control circuit in accordance with the present invention.

Referring to FIG. 2, a schematic diagram of temperature control circuit 50 in accordance with the present invention is shown. Circuit 50 preferably includes a first comparator 51 that is coupled to an auxiliary heater 52 and receives inputs from a temperature sensor 53 and line 30. Circuit 50 also contains a second comparator 61 that receives inputs from the temperature sensor (minus $\Delta$ via level shifter 63) and line 30. The output of comparitor 61 controls a field effect transistor 64 (preferably a PFET) or the like.

The comparators 51 and 61 (and the other components herein) are preferably formed within the semiconductive substrates of the printhead dies. The comparitors preferably perform functions similar to commercially available LM308 devices or the like.

The auxiliary heater may be implemented in a variety of manners which include, but are not limited to, incorporating the thermal ink expulsion mechanisms (as discussed above), formed as or supplemental to heating element 43, or as otherwise known in the art.

The temperature sensor 53 is preferably implemented using a material having a resistance that varies with temperature or through band gap and junction techniques or as otherwise known in the art. Level shifter 63 is preferably implemented with a resistor and constant current source. A voltage drop of Δ may be implemented with resistive divider networks or the like.

In operation, comparator 51 compares the printhead temperature signal to the temperature signal on line 30. When the printhead temperature signal is lower than the temperature control line signal, auxiliary heater 52 is enabled by comparator 51. While the primary function of comparator 51 is to control heating of the printhead, the primary function of comparator 61 is to control the driving of an elevated or new highest temperature signal on to line 30. If the printhead temperature signal is greater by Δ from the line temperature signal, then gate 64 is switched such that line 30 is driven by $V_{DD}$ or the like until line 30 (detected through the immediate feed back loop) reaches a level that causes comparator 61 to switch off, i.e., open circuit, the driving force.

A voltage signal driven on to line 30 is received at the control circuits of the other printheads. A comparison similar to that discussed immediately above is undertaken by each of the control circuits of the multiple printheads and if appropriate the auxiliary heating elements for those printheads are enabled to raise printhead temperatures such that they are approximately equal to the temperature indicated on line 30. In this manner, it is possible to create an environment in which adjacent printheads and more importantly ink within those printheads is provided at approximately the same temperature. As a result, there is significantly less variation in image intensity between the multiple printheads.

The use of a threshold temperature range, Δ, before an elevated or new temperature signal is driven on to line 30 prevents a positive feedback scenario in which printheads are continually heated until they reach a temperature that is too hot for proper operation. It should be recognized that conventional techniques for printhead temperature protection do exist and if a printhead threshold temperature is achieved, the printheads are simply deactivated (no firing signals are sent until they cool off). Exemplary voltage and temperature parameter include a voltage range of 1–4V that corresponds to temperature from 20 to 100° C. Δ may be approximately 150 mV and the shut-off temperature is approximately 100° C.

Figure 3:
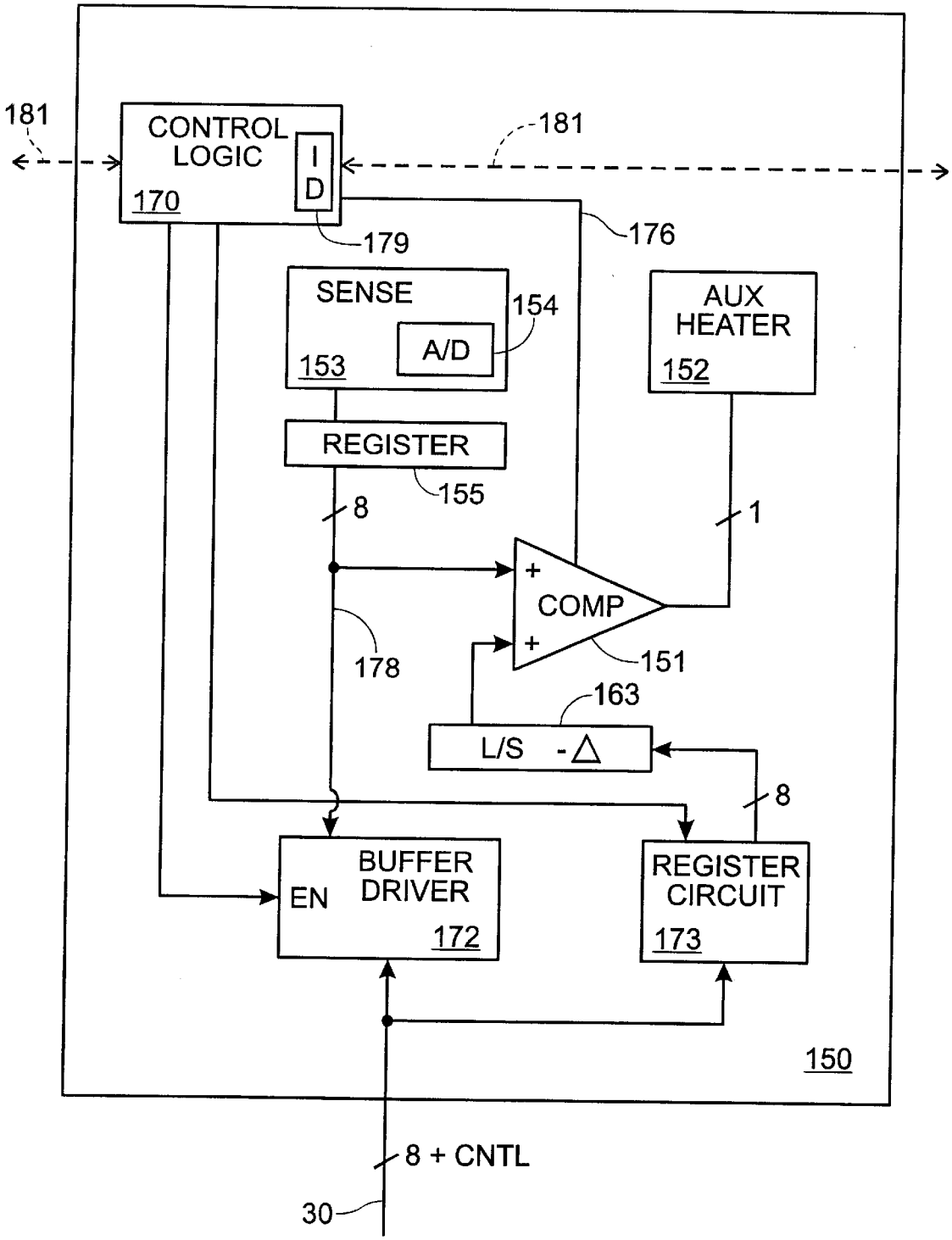
FIG. 3 is a schematic diagram of a digital implementation of a temperature control circuit in accordance with the present invention.

Referring to FIG. 3, a schematic diagram of a digital implementation of a temperature control circuit 150 in accordance with the present invention is shown. The circuit of FIG. 3 is referred to with reference numeral 150, and is intended as a substitute for circuit 50 of FIGS. 1 and 2.

Circuit 150 includes a comparator 151, auxiliary heater 152, temperature sensor 153, and level shifter 163, that are analogous in function to corresponding components in FIG. 2. Circuit 150 also includes control logic 170, a buffer driver 172, register circuit 173 and sensed temperature register 155. In operation, temperature is sensed by sensor 153, converted to a digital representation by A/D converter 154 and stored in register 155. Bus temperature is loaded from bus 30 (preferably an 8 bit bus, plus control) into register circuit 173 from which it is propagated through level shifter 163 to comparator 151. Bus 30 in the digital implementation may be a shared bus, for example, part of the system bus (with time domain multiplexing), or a dedicated bus. Level shifter 163 subtracts an appropriate Δ and if the sensed temperature held by register 155 is less than the bus temperature minus Δ, then the auxiliary heater 152 is enabled.

Control logic 170 preferably includes an ID register 179 for unique identification. The control logic is preferably coupled to the control logic of the other printhead dies through control lines associated with bus 30 or through other control signal lines indicated by phantom lines 181. The control logic control lines permit time domain multiplexing or other bus arbitration/utilization scenarios to be implemented. In a time domain multiplexing scenario, the temperatures of the other printhead dies are sequentially gated into register circuit 173 and looked at by control logic 170. Each new temperature that is gated in is compared to the preceding value and the hottest temperature is preferably retained. During the bus control interval for the printhead of FIG. 3, control logic 170 enables driver 172 which drives the temperature signal from register 155 via conductor 178 onto the bus. Control logic 170 also outputs an enable signal via conductor 176 to comparator 151 which is active when the output of comparator 151 is valid. It should be recognized that while control logic 170 is represented as being formed within a particular printhead die in FIG. 3, the control logic and related logic could alternatively be provided on an off-die processor or elsewhere.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printing apparatus, comprising:

a first printhead die and a second printhead die each having a temperature sensor;

a signal propagation circuit that propagates a temperature signal from one of said first and second printhead dies to the other of said first and second print head dies;

control logic within each of said first and second printhead dies that compares a sensed temperature signal of the printhead die within which that control logic is located to a temperature signal of the other printhead die that is propagated by said propagation circuit; and a heating mechanism within each printhead die that is coupled to the control logic of that die and increases the temperature of its respective die in response to a determination by the coupled control logic that the temperature of that die is less than that of the other die.

2. The apparatus of claim 1, wherein said control logic in each die is capable of driving a signal onto said signal propagation circuit that is indicative of the temperature of the die within which it is located.

3. The apparatus of claim 1, wherein said control logic includes a mechanism that establishes a threshold temperature between the temperature of the die on which it is located and a temperature delivered by said signal propagation circuit before a signal that results in a die temperature increase is produced.

4. The apparatus of claim 1, wherein said signal propagation circuit propagates an analog voltage that is indicative of a corresponding temperature.

5. The apparatus of claim 1, wherein said signal propagation circuit propagates a digital code that corresponds to a temperature.

* * * * *